US008763567B2

(12) United States Patent
Nakamura

(10) Patent No.: US 8,763,567 B2
(45) Date of Patent: Jul. 1, 2014

(54) ENGINE FOR PORTABLE WORKING MACHINE

(75) Inventor: Yuki Nakamura, Numazu (JP)

(73) Assignee: Makita Corporation, Aichi (JP)

( * ) Notice: Subject to any disclaimer, the term of this patent is extended or adjusted under 35 U.S.C. 154(b) by 0 days.

(21) Appl. No.: 13/609,450

(22) Filed: Sep. 11, 2012

(65) Prior Publication Data

US 2013/0068179 A1 Mar. 21, 2013

(30) Foreign Application Priority Data

Sep. 21, 2011 (JP) ..... 2011-205974

(51) Int. Cl.
*F01P 1/00* (2006.01)

(52) U.S. Cl.
USPC ..... 123/41.56; 123/41.11; 123/41.49; 123/41.63

(58) Field of Classification Search
USPC ..... 123/41.56, 41.11, 41.49, 41.63, 41.65, 123/41.48, 41.57
See application file for complete search history.

(56) References Cited

U.S. PATENT DOCUMENTS 4,536,132 A * 8/1985 Tenney ..... 417/237
4,711,750 A * 12/1987 Scott ..... 264/144
5,035,586 A * 7/1991 Sadler et al. ..... 417/363
5,269,665 A * 12/1993 Sadler et al. ..... 417/363
6,305,909 B1 * 10/2001 Jankowski et al. ..... 417/234
7,950,355 B2 * 5/2011 Nakamizo ..... 123/41.67
2007/0169726 A1 * 7/2007 Sugiyama ..... 123/41.69
2008/0184523 A1 * 8/2008 Yuasa ..... 15/412
2009/0293835 A1 * 12/2009 Nakamizo ..... 123/198 E

FOREIGN PATENT DOCUMENTS

JP 8-189359 7/1996
JP 2008-075558 4/2008
JP 2009-68378 4/2009

OTHER PUBLICATIONS

Search report from E.P.O., mail date is Feb. 20, 2013.

* cited by examiner

*Primary Examiner* — Noah Kamen
*Assistant Examiner* — Long T Tran
(74) *Attorney, Agent, or Firm* — Greenblum & Bernstein P.L.C.

(57) ABSTRACT

An engine for a portable working machine includes: a crankshaft to which the working machine is coupled; an air-cooling fan coupled to one end side of the crankshaft; a fan casing enclosing the air-cooling fan; and a bottom cover located in a bottom surface side of the engine and connected to the fan casing. Air suction ports and guide parts are provided in one side of the bottom cover, the air suction ports sucking in air supplied from the air-cooling fan, and the guide parts extending from the air suction ports to the impeller blades of the air-cooling fan.

9 Claims, 3 Drawing Sheets

ENGINE FOR PORTABLE WORKING MACHINE

CROSS-REFERENCES TO RELATED APPLICATIONS

This application claims the benefit of Japanese Patent Application No. 2011-205974, filed Sep. 21, 2011, which is incorporated herein by reference.

BACKGROUND

1. Technical Field

The present invention relates to an engine for a working machine, more specifically to an engine that can be used in a portable working machine, such as a brush cutter, a chain saw, and a power blower.

2. Related Art

Conventionally, this sort of engine for a portable working machine includes a casing to cover the engine and a cooling fan coupled to a crankshaft. The engine is cooled by flowing cooling air between the engine and the casing.

The engine for a portable working machine is used in such as a brush cutter, a chain saw and a power blower. Being held up by the user, the engine is tilted in different directions in use. At work, sometimes a portable working machine is placed on the ground while its engine is in the idle state. For example, an engine for a portable working machine has been known that has a fuel tank and a bottom cover in its lower part in order to prevent foreign matters such as weeds from getting into between the engine and the casing when the portable working machine is placed on the ground (see Japanese Patent Application Laid-Open No. 2008-75558).

The above-described engine for a portable working machine has a problem that the fuel tank and the bottom cover provided in its lower part may prevent a sufficient amount of cooling air from flowing in the engine. This may cause the performance of the engine to degrade. Therefore, the engine for a portable working machine is designed to ensure that a sufficient amount of cooling air flows therein by forming air flow ports in the bottom cover. However, if the air flow ports of the bottom cover are widened, it is possible to increase an amount of cooling air flowing in the engine for a portable working machine, but foreign matters easily come in the engine.

SUMMARY

It is therefore an object of the present invention to provide an engine for a portable working machine configured to allow cooling air to flow in the engine efficiently and prevent the engine from malfunctioning due to foreign matters such as weeds coming in from air suction ports.

In order to achieve the above-described object, the engine for a portable working machine according to the present invention includes: a crankshaft to which the working machine is coupled; an air-cooling fan coupled to one end side of the crankshaft; a fan casing enclosing the air-cooling fan; and a bottom cover located in a bottom surface side of the engine and connected to the fan casing. Air suction ports and guide parts are provided in one side of the bottom cover, the air suction ports sucking in air supplied from the air-cooling fan, and the guide parts extending from the air suction ports to the impeller blades of the air-cooling fan.

By this means, cooling air is guided to the air-cooling fan side, and, even if foreign matters come in from the air suction ports, the foreign matters are guided to the outer periphery side of the air-cooling fan. Therefore, it is possible to allow the cooling air from the air suction ports to flow in the engine efficiently, and prevent the foreign matters coming in from the air suction ports from adhering to a crankshaft.

With the present invention, it is possible to allow cooling air to flow in the engine efficiently and prevent foreign matters coming in from the air suction ports from adhering to a crankshaft. Therefore, it is possible to prevent the cooling efficiency of the engine from coming down and also prevent the occurrence of failure or malfunction.

DESCRIPTION OF EXEMPLARY EMBODIMENTS

Figure 1:
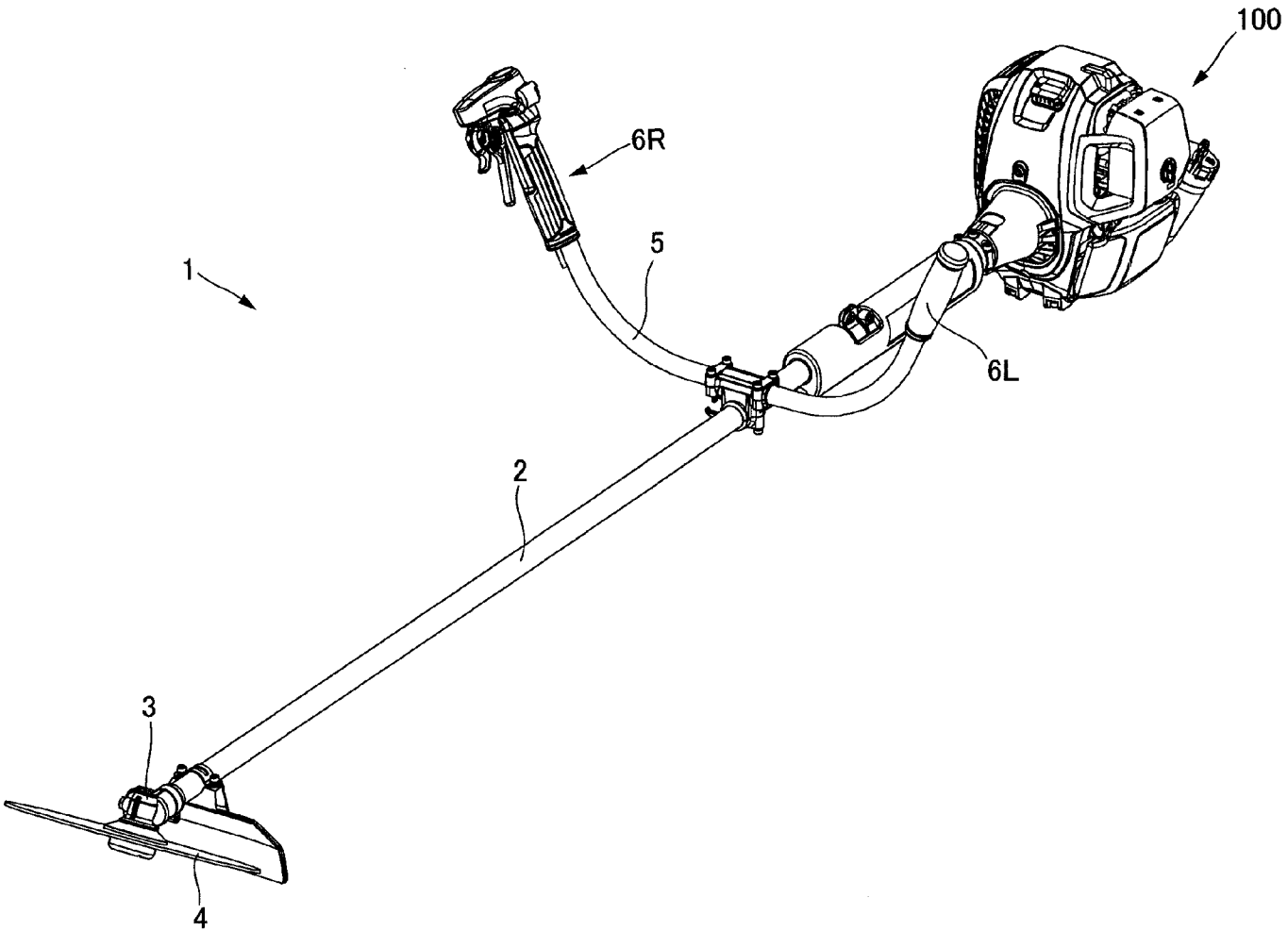
FIG. 1 is a perspective view showing a brush cutter including an engine for a portable working machine according to an embodiment of the present invention.
Figure 2:
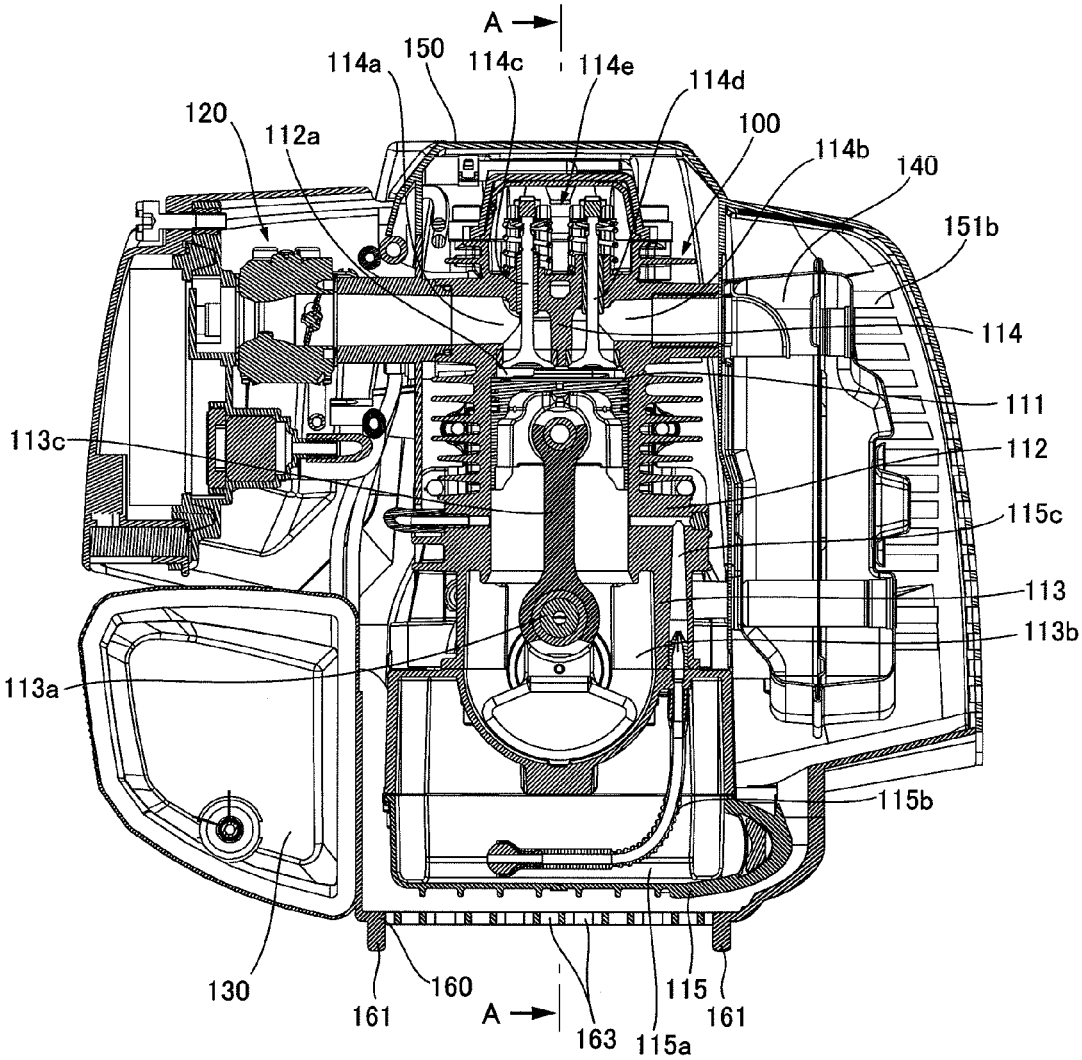
FIG. 2 is a back cross-sectional view showing the engine for a portable working machine.
Figure 3:
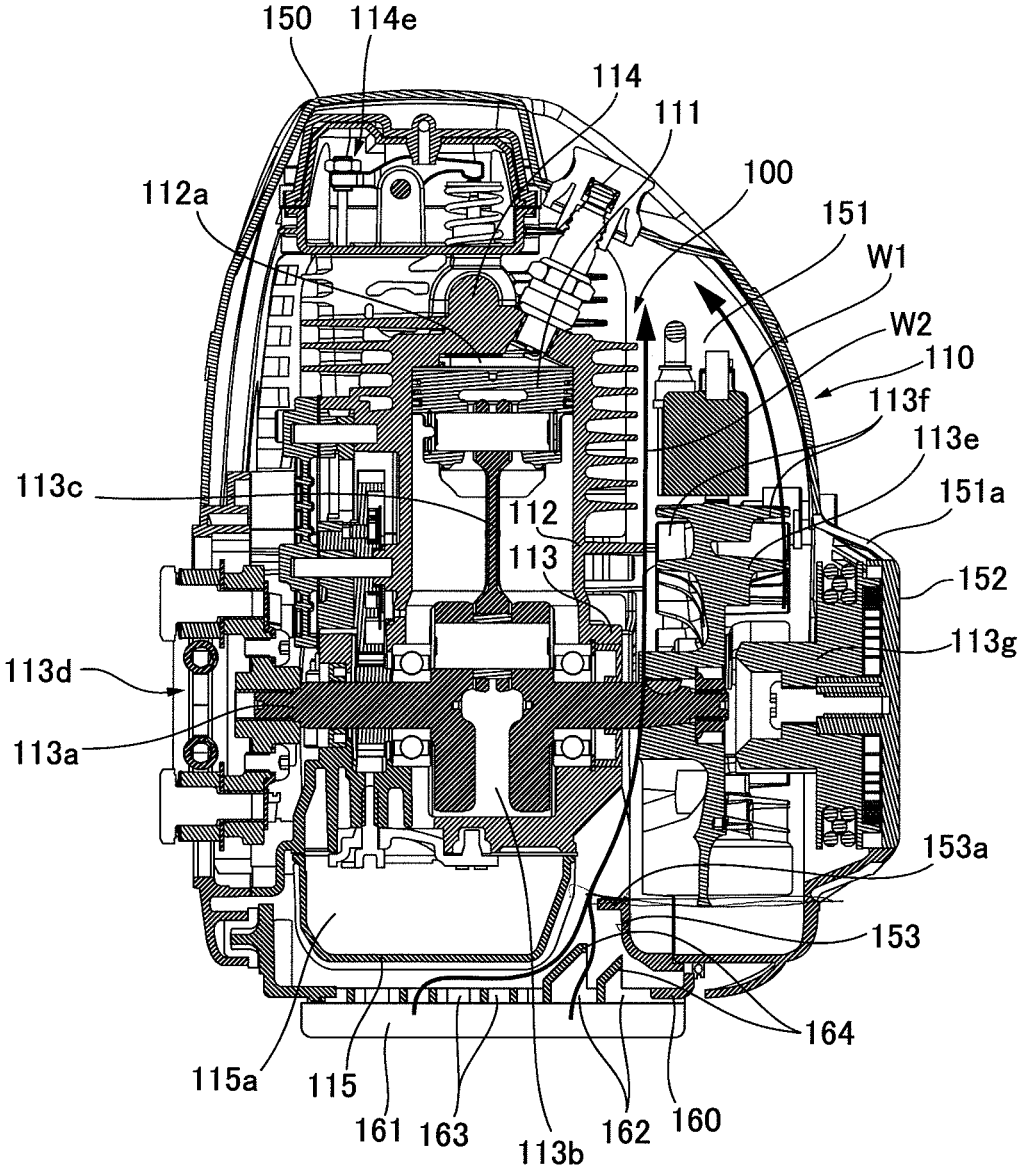
FIG. 3 is a cross sectional view of FIG. 2 taken along line A-A'.

FIG. 1 to FIG. 3 show an embodiment of the present invention. With the present embodiment, a brush cutter will be explained, as an example of a portable working machine adopting an engine for a portable working machine according to the present invention.

As shown in FIG. 1, this brush cutter 1 includes: an operation rod 2 extending in the longitudinal direction; a four-stroke engine 100 connected to the back end side of the operation rod 2; and a disc-shaped cutting blade 4 rotatably attached to the front end side of the operation rod 2 via a gear head 3.

A drive shaft (not shown) is rotatably provided in the operation rod 2. An engine 100 is coupled to the back end side of the drive shaft. A gear head 3 is coupled to the front end side of the drive shaft.

A handle 5, which is held by the user to operate the brush cutter 1, is mounted on the operation rod 2 at the position such that the distance between the front end of the operation rod 2 and the handle 5 is a little longer than the distance between the back end of the operation rod 2 and the handle 5. The handle 5 is formed by a tubular member. The handle 5 extends from the operation rod 2 to both left and right sides and bends such that both ends turn up. Grips 6L and 6R held by the left hand and the right hand of the user are provided in the respective ends of the handle 5.

As shown in FIG. 2 and FIG. 3, the engine 100 according to the present invention includes: a carburetor 120 to produce air-fuel mixture to be supplied to a combustion chamber 112*a*; a fuel tank 130 to accumulate liquid fuel such as gasoline to be supplied to the carburetor 120; an exhaust muffler 140 to discharge combustion gas from the combustion chamber 112*a*; a bottom cover 160 to cover the bottom surface of the engine 100; and a casing 150 to cover parts other than the bottom surface.

The engine 100 includes: a cylinder block 112 in which a piston 111 is provided to be able to reciprocate in the vertical direction; a crankcase 113 located below the cylinder block 112; a cylinder head 114 above the cylinder block 112 and an oil pan 115 below the crankcase 113.

The cylinder block 112 has a space in which the piston 111 can reciprocate. The combustion chamber 112*a* is formed between the upper surface of the piston 111 and the cylinder head 114.

The crankcase 113 includes a crank chamber 113*b* accommodating a crankshaft 113*a*. The crankshaft 113*a* is rotatably supported in the crankcase 113, and both front and back ends of the crankshaft 113*a* project from the crankcase 113. The piston 111 is coupled to the crankshaft 113*a* via a connecting rod 113*c*. The reciprocating motion of the piston 111 is converted into the rotational motion of the crankshaft 113*a*.

A shaft coupling part 113*d* is provided in the front end side of the crankshaft 113*a*. The back end side of the drive shaft provided in the operation rod 2 is coupled to the shaft coupling part 113*d*.

Meanwhile, a fly wheel 113*e* is provided in the backend side of the crankshaft 113*a*. This fly wheel 113*e* stabilizes the rotation of the crankshaft 113*a* and functions as an air-cooling fan that cools the engine 100. A plurality of impeller blades 113*f* are provided on both the front surface side and the back surface side of the fly wheel 113*e*. The plurality of impeller blades 113*f* on respective surfaces are apart from each other. The plurality of impeller blades 113*f* provided on the fly wheel 113*e* allow air to flow through in the direction of the diameter of the fly wheel 113*e* by the rotation of the fly wheel 113*e*. A well-known recoil starter 113*g* to activate the engine 100 is coupled to the back end side of the crankshaft 113*a*. The fly wheel 113*e* is surrounded by the crankcase 113, the cylinder block 112, the casing 150 and a recoil starter cover 152. A fan casing 110 is formed by these members surrounding the fly wheel 113*e*.

The cylinder head 114 has an intake port 114*a* and an exhaust port 114*b*. The intake port 114A introduces the air-fuel mixture produced in the carburetor 120 into the combustion chamber 112*a*, and the exhaust port 114*b* introduces the exhaust gas produced in the combustion chamber 112*a* into the exhaust muffler 140. The cylinder head 114 also has an intake valve 114*c* and an exhaust valve 114*d*. The intake valve 114*c* opens and closes the intake port 114*a* with respect to the combustion chamber 112*a*, and the exhaust port 114*d* opens and closes the combustion chamber 112*a* with respect to the exhaust port 114*b*. The intake valve 114*c* and the exhaust valve 114*d* open and close by an OHV type valve operating mechanism 114*e* including a cam shaft, a rocker arm and so forth.

The oil pan 115 is fixed to the bottom of the crankcase 113. An oil tank chamber 115*a* is formed between the crankcase 113 and the oil pan 115 to accumulate lubricating oil therein. The oil tank chamber 115*a* is connected to the crank chamber 113*b* via a flexible pipe 115*b* and a communicating path 115*c* provided in the crankcase 113, and communicates with the crank chamber 113*b* according to the reciprocating motion of the piston 111. The lubricating oil accumulated in the oil tank chamber 115*a* lubricates the parts in the crank chamber 113*b* and the parts constituting the valve operating mechanism 114*e*, and then returns to the oil tank chamber 115*a*.

As shown in FIG. 2, the carburetor 120 is provided on the left side of the cylinder head 114 and is connected to the intake port 114*a*. Respective one ends of a suction pipe (not shown) and a return pipe (not shown) are connected to the carburetor 120 while the other ends are connected to the fuel tank 130.

The fuel tank 130 is formed by a member made of synthetic resin, and provided in a space below the carburetor 120 on the left side of the crankcase 113, as shown in FIG. 2.

The exhaust muffler 140 is provided on the right side of the cylinder head 114 and connected to the exhaust port 114*b*.

The casing 150 is provided apart from the rear surface of the cylinder block 112. An air flow passage 151 is provided between the casing 150 and the rear surface of the cylinder block 112. The air flow passage 151 extends in the vertical direction to allow air to flow upward from the bottom end side by the rotation of the fly wheel 113*e*. Moreover, a partition wall 153 is provided between the oil pan 115 and the fly wheel 113*e* in the lower part of the air flow passage 151. This partition wall 153 separates between the front side and the back side of the space below the fly wheel 113*e* along the outline of the fly wheel 113*e*. An extending part 153*a* extending from the upper end of the partition wall 153 to the oil pan 115 side is provided along the upper end of the partition wall 153.

An air suction port 151*a* is formed in a recoil starter cover 152 located in the lower part of the air flow passage 151. Moreover, an exhaust port 151*b* is provided in the upper right side (the exhaust muffler 140 side) of the air flow passage 151 to discharge the air flowing through the air flow passage 151 to the outside.

The bottom cover 160 is formed integrally with the fuel tank 13 located in the left side as shown in FIG. 2. Leg parts 161 extending along the longitudinal direction and projecting downward are provided on the bottom surface of the bottom cover 160 at both sides in the width direction of the bottom cover 160. A plurality of air suction ports 162 are formed in part of the bottom cover 160, which is between the leg parts 161 and near the fly wheel 113*e*. Also a plurality of air suction ports 163 are formed in the other part of under cover 160, which is between the leg parts 161 but not near the fly wheel 113*e*. Guide plates 164 are provided on the respective edges of the air suction ports 162 located near the fly wheel 113*e* and are formed integrally with the bottom cover 160. The guide plates 164 guide the air flowing from the air suction ports 162 to the fly wheel 113*e* side, and also guide the foreign matters such as weeds coming in from the air suction ports 162 to the outer periphery side of the fly wheel 113*e*. Each guide plate 164 extends from the edge of the air suction port 162 to the oil pan 115 side while its end extends obliquely upward to the outer periphery of the fly wheel 113*e*.

Shielding structure is provided between the air suction ports 162 and the fly wheel 113*e* and also between the air suction ports 163 and the fly wheel 113*e*, respectively, to shield the fly wheel 113*e* from the air suction ports 162 and 163.

To be more specific, the fly wheel 113*e* is shielded from the air suction ports 162 near the fly wheel 113*e* by the partition wall 153, the extending part 153*a* and the guide plates 164 to prevent the foreign matters coming in from directly contacting the fly wheel 113*e*. Meanwhile, the fly wheel 113*e* is shielded by the oil pan 115, from the air suction ports 163 located in the part other than the part near the fly wheel 113*e*.

When the engine 100 for a portable working machine having the above-described configuration is driven, the fly wheel 113*e* rotates with the crankshaft 113*a*, and therefore air flows in the air flow passage 151 from the air suction port 151*a* due to the action of the impeller blades 113*f* provided on the rear surface of the fly wheel 113*e*. The air having flown into the air flow passage 151 cools the cylinder head 114 and the valve operating mechanism 114*e* and then is discharged from the exhaust port 151*b* as indicated by arrow W1 in FIG. 3.

In addition, when the engine 100 is driven, air flows in the air flow passage 151 from the air suction ports 162 and 163 in the bottom cover 160 due to the action of the impeller blades 113*f* provided on the front surface of the fly wheel 113*e*. The air having flown into the air flow passage 151 cools the oil pan 115, the crankcase 113, the cylinder block 112, the cylinder head 114 and the valve operating mechanism 114*e* while flowing through the air flow passage 151, and then is discharged from the exhaust port 151*b*. At this time, the air flowing from the air suction ports 163 into the air flow passage 151 is guided into the fly wheel 113*e* side by the guide plates 164.

In the meantime, when the brush cutter 1 is placed on the ground with weeds, weeds may come in from the air suction ports 162 and 163 in the bottom cover 160. The weeds coming in from the air suction ports 162 are guided to the outer periphery side of the fly wheel 113*e* by the guide plates 164. The weeds guided by the guide plates 164, to the outer periphery side of the fly wheel 113*e* are blocked by the partition wall 153 and the extending part 153*a*, and therefore cannot reach the crankshaft 113*a* which is the center of the rotating part of the fly wheel 113*e*. In addition, even if the engine 100 is being driven, the weeds do not adhere to the fly wheel 113*e*. Moreover, the weeds coming in from the air suction ports 163 are blocked by the oil pan 115, and therefore cannot reach the center of the rotating part of the fly wheel 113*e*. In addition, even if the engine 100 is being driven, the weeds do not adhere to the fly wheel 113*e*.

As described above, in the engine 100 for a portable working machine according to the present embodiment, the air suction ports 162 and the guide plates 164 are provided in one end side of the bottom cover 160. The air suction ports 162 suck in the air supplied from the impeller blades 113*f* of the flywheel 113*e*. The guide plates 164 extend from the air suction ports 162 to the outside of the impeller blades 113*f* of the fly wheel 113*e*. By this means, it is possible to guide the weeds coming in from the air suction ports 162 to the outside of the fly wheel 113*e* while the air entering from the air suction ports 162 is directed to the fly wheel 113*e* side. Therefore, it is possible to prevent the cooling efficiency of the engine 100 from degrading and also prevent weeds from adhering to the crankshaft 113*a*, and therefore reduce the possibility of occurrence of failure or malfunction.

The guide plates 164 extend from the air suction ports 162 to the impeller blade 113*f* of the fly wheel 113*e*. By this means, it is possible to chop up the weeds coming in from the air suction ports 162 by the impeller blades 113*f* of the fly wheel 113*e* to prevent the weeds from adhering to the crankshaft 113*a*.

Meanwhile, the shielding structure is provided between the air suction ports 162 and the fly wheel 113*e* and also between the air suction ports 163 and the fly wheel 113*e*, respectively, to shield the fly wheel 113*e* from the air suction ports 162 and 163. By this means, the weeds coming in from the air suction ports 162 and 163 cannot easily reach the center of the rotating part of the fly wheel 113*e*, and therefore it is possible to effectively prevent the weeds from adhering to the crankshaft 113*a*.

The shielding structure is formed by the guide plates 164 and the components constituting the engine 100. Therefore, any dedicated components are not required to form the shielding structure, besides the components constituting the engine 100. Consequently, it is possible to reduce the number of parts. In addition, since the shielding structure is formed by the components constituting the engine 100, design flexibility is higher than in a case in which the shielding structure is provided only by the guide plates 164.

Moreover, the shielding structure is formed by the oil pan 115 and the guide plates 164. Therefore, it is possible to flow the air flowing in from the air suction ports 163 along the bottom surface of the oil pan 115, and therefore efficiently cool the lubricating oil in the oil tank chamber 115*a*.

Although with the embodiment, a brush cutter 1 has been used as an example of working machines to which the engine 100 is applied, it is by no means limiting. For example, a chain saw and a power blower are possible as long as they are portable.

In addition, although with the embodiment, the four-stroke engine 100 has been used as an example of engines for a working machine, it is by no means limiting. The present invention is applicable to a two-stroke engine, and in this case, it is possible to produce the same effect.

Moreover, although with the present embodiment, the vertical-mounted engine 100 is used as an example, where the cylinder head 114 is located above the cylinder block 112 and the crankcase 113 is located below the cylinder block 112, it is by no means limiting. For example, a traverse-mounted engine is possible where the cylinder head 114 is located in one side of the cylinder block 112 in the horizontal direction, and the crankcase 113 is located in the other side of the cylinder block 112.

Furthermore, although with the embodiment, a fan means has a configuration where the fly wheel 113*e* having both surfaces with the impeller blades 113*f* is coupled to the crankshaft 113*a*, it is by no means limiting. For example, another configuration is possible where a dedicated impeller having both surfaces with impeller blades is coupled to the crankshaft 113*a* as long as it is possible to allow air to flow by the rotation of the crankshaft 113*a*.

The invention claimed is:

1. An engine for a portable working machine, comprising:
- a crankshaft to which the working machine is coupled;
- an air-cooling fan having impeller blades and coupled to one end side of the crankshaft;
- a fan casing enclosing the air-cooling fan; and
- a bottom cover located in a bottom surface side of the engine and connected to the fan casing,
- wherein air suction ports and guide parts are provided in one side of the bottom cover, the air suction ports sucking in air supplied from the air-cooling fan, the guide parts extending from the air suction ports to the impeller blades of the air-cooling fan, and the guide parts comprising at least one guide plate extending from an edge of one of the air suction ports in a direction obliquely upwards towards an outer periphery of the air-cooling fan.

2. The engine for a portable working machine according to claim 1, wherein a shielding structure is provided between a first plurality of the air suction ports and the air cooling fan and also between a second plurality of the air suction ports and the air cooling fan, respectively, to shield the air-cooling fan from air coming in from the air suction ports.

3. The engine for a portable working machine according to claim 2, wherein the shielding structure is formed by the guide parts, and components including a cylinder block and a crankcase which constitute the engine.

4. The engine for a portable working machine according to claim 3, wherein: the engine for a portable working machine includes a four-stroke engine configured to lubricate driving parts by circulating lubricating oil and has an oil tank to accumulate the lubricating oil; and the shielding structure is formed by the oil tank and the guide parts.

5. The engine for a portable working machine according to claim 2, wherein: the engine for a portable working machine includes a four-stroke engine configured to lubricate driving parts by circulating lubricating oil and has an oil tank to accumulate the lubricating oil; and the shielding structure is formed by the oil tank and the guide parts.

6. The engine for a portable working machine according to claim 1, wherein a shielding structure that shields the air-cooling fan from air coming in from the air suction ports is formed by the guide parts, and components including a cylinder block and a crankcase which constitute the engine.

7. The engine for a portable working machine according to claim 6, wherein: the engine for a portable working machine includes a four-stroke engine configured to lubricate driving parts by circulating lubricating oil and has an oil tank to accumulate the lubricating oil; and the shielding structure is formed by the oil tank and the guide parts.

8. The engine for a portable working machine according to claim 6, wherein: the engine for a portable working machine includes a four-stroke engine configured to lubricate driving parts by circulating lubricating oil and has an oil tank to accumulate the lubricating oil; and the shielding structure is formed by the oil tank and the guide parts.

9. The engine for a portable working machine according to claim 1, wherein the guide parts comprises a plurality of guide plates extending from corresponding edges of adjacent air suction ports.

* * * * *